US007963054B2

(12) United States Patent
Wimmer et al.

(10) Patent No.: US 7,963,054 B2
(45) Date of Patent: Jun. 21, 2011

(54) COUPLING CONFIGURATION WITH A DEVICE FOR CONNECTING ENERGY TRANSMISSION LINES

(75) Inventors: Alois Wimmer, Hof bei Salzburg (AT); Erich Greisberger, Thalgau (AT)

(73) Assignee: Wimmer Hartstahl GmbH & Co. KG, Thalgau (AT)

( * ) Notice: Subject to any disclaimer, the term of this patent is extended or adjusted under 35 U.S.C. 154(b) by 3 days.

(21) Appl. No.: 12/407,811

(22) Filed: Mar. 20, 2009

(65) Prior Publication Data

US 2009/0255151 A1 Oct. 15, 2009

(30) Foreign Application Priority Data

Mar. 20, 2008 (AT) ..... A 443/2008

(51) Int. Cl.
*E02F 3/96* (2006.01)

(52) U.S. Cl. ..... 37/468; 172/272

(58) Field of Classification Search ..... 37/468, 37/443, 403; 414/723; 172/272, 275
See application file for complete search history.

(56) References Cited

U.S. PATENT DOCUMENTS

| | | | | |
|---|---|---|---|---|
| 4,663,866 | A * | 5/1987 | Karlsson et al. | 414/723 |
| 4,738,463 | A * | 4/1988 | Poore et al. | 280/421 |
| 4,955,779 | A * | 9/1990 | Knackstedt | 414/723 |
| 5,024,010 | A * | 6/1991 | Hulden | 37/417 |
| 5,147,173 | A * | 9/1992 | Fauber et al. | 414/723 |
| 5,333,400 | A * | 8/1994 | Sonerud | 37/468 |
| 5,465,513 | A | 11/1995 | Sonerud | |
| 5,802,753 | A * | 9/1998 | Raunisto | 37/468 |
| 5,890,871 | A * | 4/1999 | Woerman | 414/723 |
| 6,196,595 | B1 * | 3/2001 | Sonerud | 285/26 |
| 6,813,851 | B2 * | 11/2004 | Mieger et al. | 37/468 |
| 6,899,509 | B1 * | 5/2005 | Mailleux | 414/723 |
| 7,198,451 | B2 | 4/2007 | Wimmer | |
| 7,246,457 | B2 * | 7/2007 | Mieger et al. | 37/468 |
| 7,290,977 | B2 * | 11/2007 | Albright et al. | 414/723 |
| 7,464,967 | B2 * | 12/2008 | Mieger et al. | 285/124.5 |
| 7,594,776 | B2 * | 9/2009 | Steig et al. | 403/322.3 |

(Continued)

FOREIGN PATENT DOCUMENTS

| | | | |
|---|---|---|---|
| AT | 500 900 | A1 | 4/2006 |
| AT | 008623 | U2 | 10/2006 |
| AT | 505238 | A1 | 12/2008 |
| DE | 102004014824 | A1 | 10/2005 |
| DE | 102006023420 | A1 | 11/2007 |
| EP | 1840276 | A2 | 3/2007 |

(Continued)

*Primary Examiner* — Thomas B Will
*Assistant Examiner* — Jamie L McGowan
(74) *Attorney, Agent, or Firm* — Laurence A. Greenberg; Werner H. Stemer; Ralph E. Locher

(57) ABSTRACT

A coupling apparatus having a device for automatic connection of power lines, in particular of hydraulic lines, for the attachment of working tools to a tool mount of a excavator boom by means of a quick-action coupling, wherein, in order to connect the tool mount to the working tool, the quick-action coupling has a hook connection and a blocking unit with a movable bolt element which is operated by an actuating unit. Supply connecting pieces are fixed to the tool mount, and the corresponding power take-off connecting pieces of the working tool are fixed on a mount, which is mounted on the working tool such that it can move between a moved-forward position and a drawn-back position, wherein the mount has a driver piece for engagement with an operating element which is coupled to the movable bolt element. When the blocking unit is closed, the power take-off connecting pieces are connected to the corresponding supply connecting pieces and, when the blocking unit is open, they are detached from the supply connecting pieces.

8 Claims, 6 Drawing Sheets

U.S. PATENT DOCUMENTS

| | | | | |
|---|---|---|---|---|
| 7,654,019 | B2 * | 2/2010 | Yeager et al. | 37/468 |
| 2003/0154636 | A1 * | 8/2003 | Miller et al. | 37/468 |
| 2009/0051163 | A1 * | 2/2009 | Frey et al. | 285/305 |
| 2009/0235561 | A1 * | 9/2009 | Muller | 37/468 |
| 2009/0282712 | A1 * | 11/2009 | Pruszynski | 37/468 |

FOREIGN PATENT DOCUMENTS

| | | | |
|---|---|---|---|
| WO | 93/05241 | A1 | 3/1993 |
| WO | 2005093171 | A1 | 10/2005 |
| WO | 2007131800 | A1 | 11/2007 |
| WO | 2008151334 | A1 | 12/2008 |

* cited by examiner

COUPLING CONFIGURATION WITH A DEVICE FOR CONNECTING ENERGY TRANSMISSION LINES

BACKGROUND OF THE INVENTION

Field of the Invention

The present invention relates to a coupling apparatus having a device for automatic connection of power lines, in particular of hydraulic lines, for the attachment of working tools to a tool mount of a excavator boom by means of a quick-action coupling, wherein, in order to connect the tool mount to the working tool, the quick-action coupling has a hook connection and a blocking unit with a movable bolt element which is operated by an actuating unit.

Many tools which can be used with excavators are not only movable as an entity via the excavator boom but additionally have their own drives or actuating units which are connected to the excavator, and are supplied with power, via a supply line. These tools include, for example, grippers, (demolition) tongs, milling heads, hammers or drills, which are generally hydraulically driven.

Since most conventional quick-action couplings for excavator booms are designed primarily to allow the tools to be attached easily and robustly, the hydraulic connections are often connected to one another manually and individually after the tool has been coupled to the quick-action coupling. This is disadvantageous since the connections from the tool or from the arm project freely or can hang down as soon as they are disconnected from one another. Furthermore, the connections on the excavator boom create a disturbing impediment when tools without a hydraulic supply, such as simple shovels, are fitted to the arm, and must therefore be supplied in addition before use of these tools, in order to avoid damage during use.

More modern coupling systems have attempted to avoid these disadvantages by also integrating a dedicated automatic coupling for the hydraulic connections, in addition to the quick-action coupling for the tool, on the tool mount. The supply connecting pieces on the tool mount are held on a common support structure, for example in the form of a plate, and, when no tool is connected (or a tool without hydraulics), they are located in a drawn-back and protected position. When a tool with hydraulics is to be connected to this system, then the plate is moved out of its drawn-back position after the tool has been coupled to its own actuating unit, and is pushed against corresponding power take-off connecting pieces, which are arranged on the tool, thus making the connection. Embodiments such as these occupy a considerable amount of space and generally have the disadvantage that the supply connecting pieces between the tool mount and the tool are concealed in the interior of the quick-action coupling, as soon as a tool has been connected. Relatively old tools, which admittedly use the same quick-action coupling system but have not yet been equipped with the system for the hydraulic connections, therefore cannot be connected to the arm since it is no longer possible to connect the power take-off connecting pieces manually, because the supply connecting pieces are arranged in a concealed position. Because of the need for two actuating units (one for the quick-action coupling and one for the hydraulic connections), safety precautions must be taken to ensure that the hydraulic connections are detached before the quick-action coupling is operated.

WO 93/05241 discloses a quick-action coupling in which the supply connecting pieces are also moved with the blocking unit on the tool mount during locking of the quick-action coupling, and therefore engage with the power take-off connecting pieces which are mounted fixedly on the tool. The hydraulic connections are arranged in the interior of the quick-action coupling, between the tool mount and the tool, such that the space which is available for the connecting pieces is greatly restricted. Even if only two hydraulic connections are provided, as is the case in the document mentioned above, tight constraints are placed on the need for a compact configuration of the quick-action coupling when using this system. The supply hydraulic connecting pieces are then also operated by the blocking unit when tools without hydraulics are used. This leads to the connecting pieces quickly becoming dirty and worn.

BRIEF SUMMARY OF THE INVENTION

The present invention overcomes the above disadvantages of the prior art by fixing supply connecting pieces to the tool mount, and by fixing the corresponding power take-off connecting pieces of the working tool on a carrier which is mounted on the working tool such that it can move between a moved-forward position and a drawn-back position, wherein the carrier has a driver piece for engagement with an operating element which is coupled to the movable bolt element, wherein, when the blocking unit is closed, the power take-off connecting pieces are connected to the corresponding supply connecting pieces and, when the blocking unit is open, they are detached from the supply connecting pieces. When the quick-action coupling is pivoted in, the actuating unit is therefore connected to the carrier via the bolt element, the operating element and the driver element and, on blocking of the blocking unit, automatically draws this to a position in which the connections are made. This allows the tool mount to be designed to be more compact since the moving parts of the hydraulic coupling are no longer located on the tool mount, but on the tool. Supply connecting pieces which are mounted fixed on the tool mount can, furthermore, be covered very easily (for example by a protective cap), and are thus optimally protected against wear, dirt and damage when the excavator is used with tools without any hydraulic function over a long time. The need to supply and/or to secure hydraulic hoses which project or hang down when a tool without hydraulics is being used is obviated. This also makes it easier to change frequently between tools with and without hydraulics.

BRIEF SUMMARY OF THE INVENTION

In one particular embodiment of the invention, the carrier can be mounted with clearance with respect to the working tool. This compensates for position tolerances which can occur as a result of dirt or wear between the tool mount and the tool, since the carrier can automatically be matched to the position of the supply hydraulic connecting pieces on the tool mount when the hydraulic coupling is closed.

The carrier can advantageously have a base which is essentially in the form of a plate, can be moved along a linear guide, preferably along guide rails which is or are provided on the working tool, and, if required, can be adjusted by means of alignment pins. This means that the connecting pieces are easy to fit, to remove, to clean and to maintain. The guide rails on which the carrier is guided linearly also allow the carrier to be moved essentially parallel, when there is clearance in the bearing.

On the other hand, the carrier may have a base which is essential in the form of a plate and is mounted on the working tool such that it can pivot for connection and detachment of the connecting pieces. This allows the space required for the carrier to be reduced further.

In order to secure the position of the connecting pieces when the working tool is disengaged, a latching device for fixing the carrier in its moved-back position when the working tool is disengaged can be provided on the working tool.

In one preferred embodiment, the operating element may have a T-groove, wherein the driver piece may be in the form of a T-head which fits the T-groove. A T-groove connection is particularly resistant to tolerance-dependent dimension discrepancies and allows autonomous sliding self-adjustment of the T-groove coupling, for example when the tool mount is moved with respect to the tool during the blocking process.

In order to ensure reliable coupling or detachment of the hydraulic lines, the driver piece is attached to the carrier such that it can be adjusted with respect to the distance of the T-head from the carrier.

In order to prevent damage to the connecting pieces or to the carrier while the quick-action coupling is being pivoted in, inward-pivoting guide surfaces respectively can in each case be provided on the tool mount, preferably on both sides along the operating element, and on the working tool, preferably on both sides along the driver piece. This ensures that the operating element and driver piece engage in one another securely during coupling.

A further preferred embodiment of the invention provides that the bolt element of the blocking unit is in the form of a transverse bar, which is flattened in the form of a wedge at least in the area of its ends and to which the actuating unit is fitted centrally, wherein the wedge point or points runs or run parallel to the longitudinal axis of the transverse bar and are or is aligned toward the actuating unit, wherein the operating element is attached to the transverse bar centrally on the wedge rear face, and wherein the supply connecting pieces of the tool mount are arranged above the wedge center plane and behind the wedge rear face. The advantage of this embodiment is that the supply connecting pieces are arranged in a protected position on the tool mount and therefore also do not impede the connection of tools which do not have their own hydraulic connecting pieces. Even relatively old tools can be connected whose coupling system admittedly matches the quick-action coupling system but which still do not have the hydraulic coupling according to the invention, but have conventional connecting pieces which project or hang down from the tool on hydraulic hoses. In this case, these hydraulic lines can be manually coupled to the supply connecting pieces of the tool mount.

BRIEF DESCRIPTION OF THE DRAWING FIGURES

One exemplary embodiment of the invention will be described in the following text with reference to the drawings.

BRIEF DESCRIPTION OF THE DRAWING FIGURES

Figure 7:
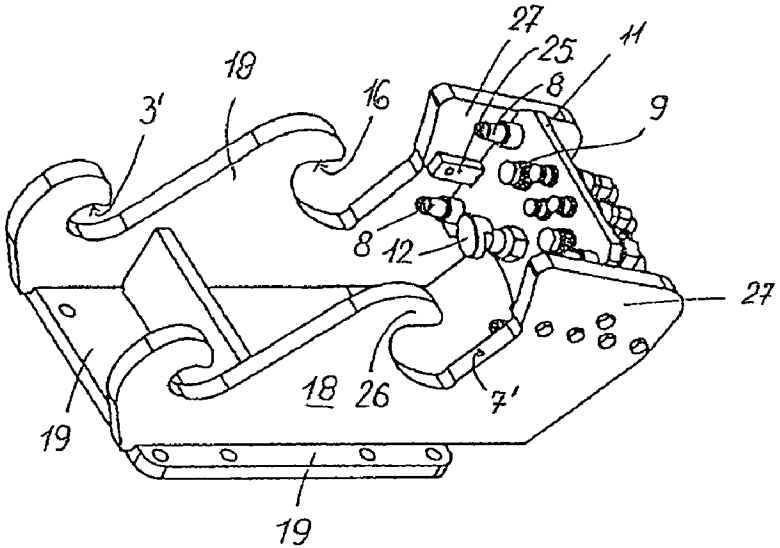
FIG. 7 shows a diagrammatic illustration of the part of the quick-action coupling illustrated in FIGS. 5 and 6.
Figure 5:
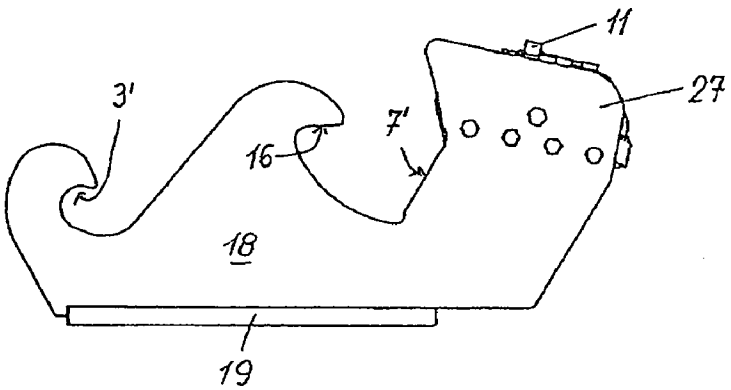
FIG. 5 shows a side view of the tool-side part of the quick-action coupling.
Figure 6:
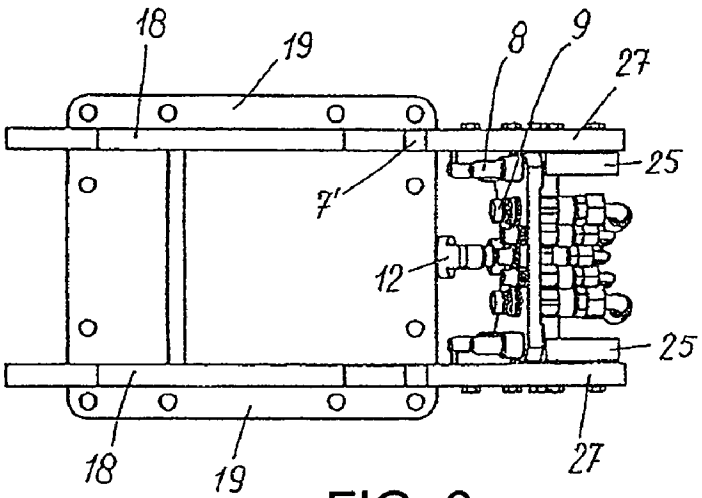
FIG. 6 shows a plan view of the same part.
Figure 8:
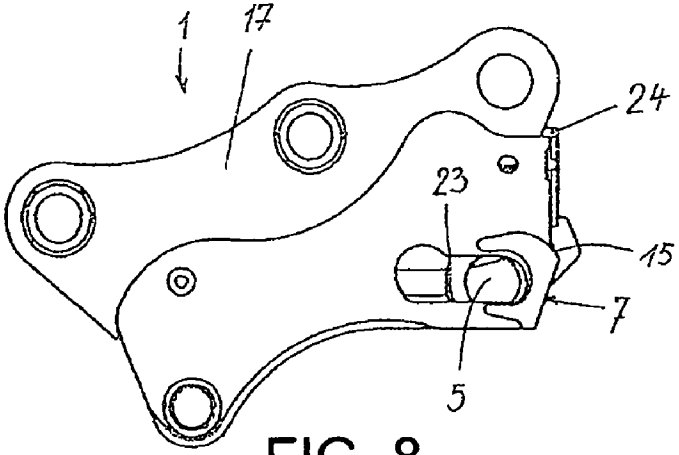
FIG. 8 shows a side view of the part of the quick-action coupling which is located on the arm.
Figure 9:
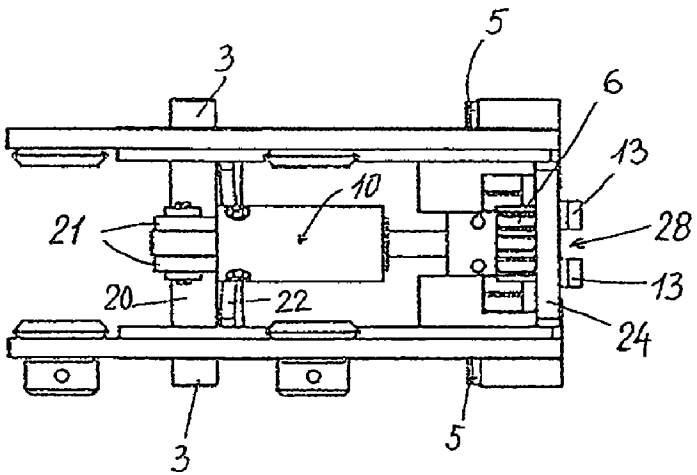
FIG. 9 shows a plan view of the same part.
Figure 10:
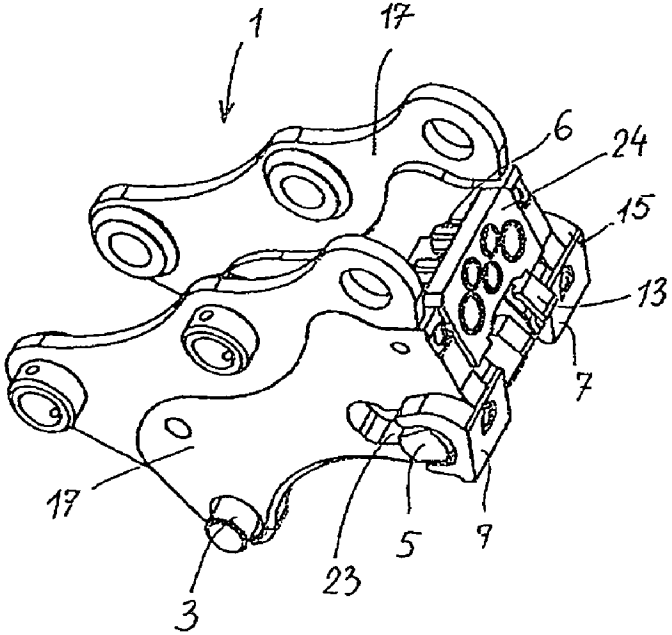
FIG. 10 shows a diagrammatic illustration of that part of the quick-action coupling which is illustrated in FIGS. 8 and 9.
Figure 11:
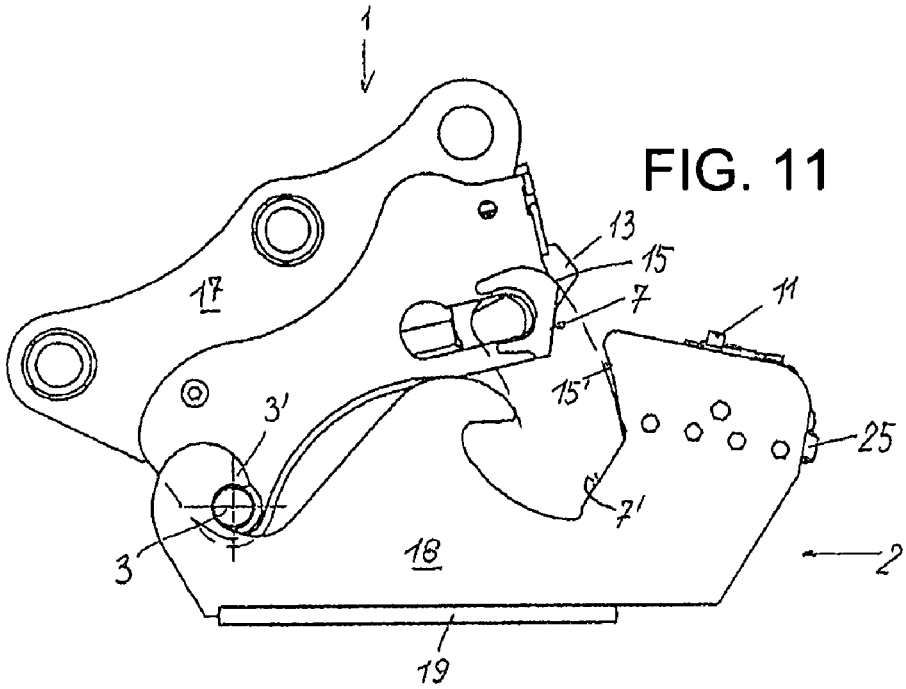
FIG. 11 shows a side view of the quick-action coupling with the hook connection hooked in, before pivoting in, in order to explain the method of operation of the guide surfaces.
Figure 12:
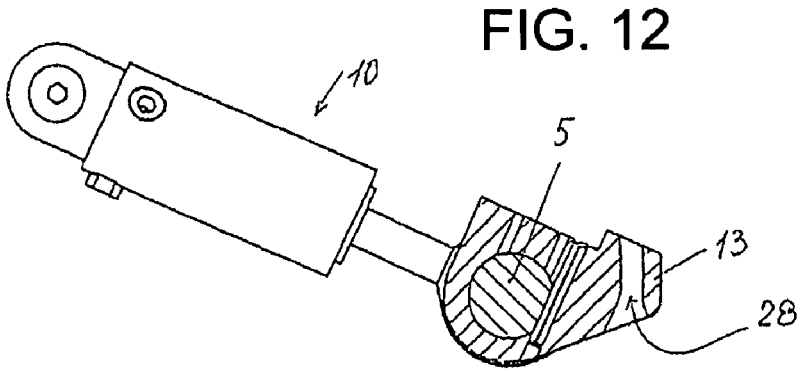
FIG. 12 shows a detailed illustration of the actuating unit with the bolt element and operating element in the form of a section along the line XII-XII in the FIG. 13.
Figure 13:
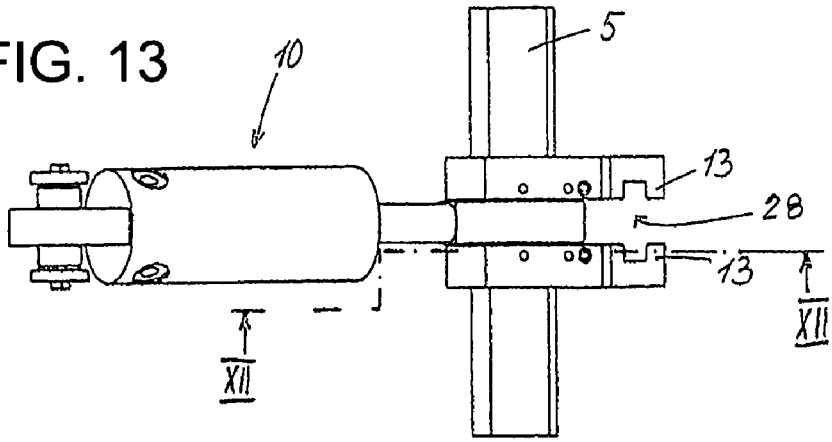
FIG. 13 shows a plan view of the parts illustrated in FIG. 12.
Figure 16:
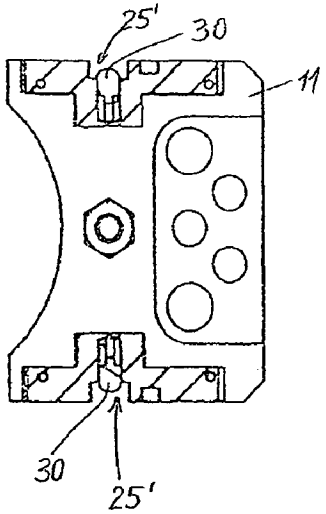
FIG. 16 shows the carrier in a section along the line XVI-XVI in FIG. 17.
Figure 17:
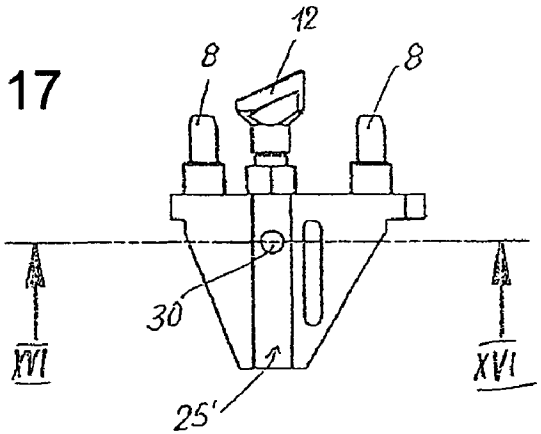
FIG. 17 shows a side view of the carrier.
Figure 14:
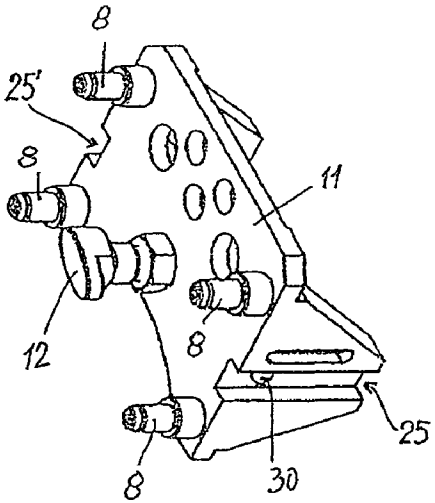
FIG. 14 shows a diagram of the carrier.
Figure 15:
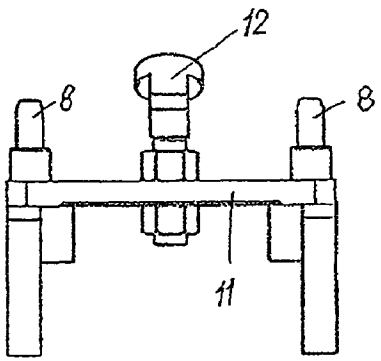
FIG. 15 shows a plan view of the carrier.

FIGS. 1 to 4 show the process of coupling the quick-action coupling. The figures each show those elements of the working tool 2 which are relevant for the coupling, in which working tool 2 the tool mount 1 which is arranged at the end of a excavator boom engages. The coupling element of the working tool 2 is once again illustrated without the tool mount 1 in FIGS. 5 to 7, and the tool mount 1 is illustrated detached in FIGS. 8 to 10. All the figures each show only those elements which are relevant for the invention, in particular with the mechanical-digger arm and the actual tool not being illustrated, in order to ensure clarity of the illustrations.

DETAILED DESCRIPTION OF THE INVENTION

The locking unit of the quick coupling, which is illustrated in the figures, that is to say the quick coupling without the elements for the hydraulic connections, is based on an embodiment of a quick-action coupling which was disclosed on Apr. 15, 2006 in Austrian Patent Specification AT 500 900 A1 and was filed by the same applicant as the present invention. The particular advantages which result from this embodiment of the locking unit of a quick-action coupling are described in detail in AT 500 900 A1. Since the cited document has been published and is available in the specialist world, the details of the known embodiment are described in the present document only to the extent that this appears to be necessary for understanding and for implementation of the invention.

Those elements of the tool mount 1 which are illustrated and are relevant for the invention are essentially the two parallel coupling plates 17, a cylindrical transverse strut 20, which forms a suspension bolt 3 at each of its ends (FIGS. 8 and 9), an actuating unit 10, a wedge bar 5, an operating element 13 and a plurality of supply connecting pieces 6, which are fixed between the coupling plates 17, obliquely above the wedge bar 5. The actuating unit 10 essentially comprises a hydraulic cylinder which is attached to the transverse strut 20 via a lug 21. In order to reduce the bending forces that act on the lug 21, the lug 21 is also supported on the coupling plate 17 via a connecting web 22. The cylindrical piston of the actuating unit 10 acts in the center of the wedge bar 5, with the wedge bar 5 being mounted on both sides in a respective guide slot 23 (see FIGS. 8 and 10) such that it can move transversely with respect to its longitudinal axis, and can thus be drawn by the actuating unit 10 from an unlocked position (extended cylindrical piston) to a locking position (cylindrical piston retracted). A closure plate 24 is arranged obliquely above the wedge bar and transversely between the coupling plate 17, and contains the hydraulic supply connecting pieces 6, which are in the form of female connectors. The hydraulic supply connecting pieces 6 are connected to L-pieces in the area between the coupling plates 17, and these L-pieces are in turn connected to the hydraulic lines coming from the excavator (not illustrated). The operating element 13 is connected to the wedge bar 5 in its center and projects underneath the closure plate 24, pointing away from the actuating unit 10, beyond the plane of the closure plate 24. An open T-groove 28 is incorporated on the side facing away from the actuating unit 10 in the actuating element 13 and is arranged such that it runs essentially tangentially with respect to a movement path, which runs around the longitudinal axis of the cylindrical transverse strut 20. When the actuating unit 10 draws the wedge bar 5 to the blocking position, the operating element 13, which is connected to the wedge bar 5, is drawn back behind the plane of the closure plate 24.

DESCRIPTION OF THE INVENTION

In addition, only those elements which are essential for the coupling process are illustrated on the tool side, that is to say in particular two mounting plates 18, the elements of the hydraulic coupling (8, 9, 11, 12, 13, 25) and a mounting flange 19 which is reinforced by a transverse strut and is used as a base for the two mounting plates 18. The actual tool (not illustrated) is connected to the lower face of the mounting flange 19; by way of example, this could be a gripper, (break-off) tongs, a milling head, a hammer, a drill or some other special tool which is suitable for use with a excavator. The mounting plates 18 are shaped to form hooks 3' in one end area, in which hooks 3' the suspension bolts 3 of the tool mount 1 can be inserted. In the center, both mounting plates 18 have locking attachments 26 with wedge inclined surfaces 16 which are directed downward and are used as an opposing member for the wedge surface of the wedge bar 5 during locking of the quick-action coupling. At the end of the mounting plates 18 which are opposite the hook side, the mounting plates 18 broaden upward and form side protective plates 27 between which a protected area is formed in which the moving parts of the hydraulic coupling are arranged and are shielded against external influences. Furthermore, a respective opposing pressure surface 7' and, above this, a respective pivoting-in guide surface 15' whose function will be described further below are, furthermore, formed on the side protective plates 27 of mounting plates 18, on the side pointing toward the hook 3' and, respectively, toward the locking attachment 26 and the wedge inclined surface 16.

Guide rails 25 are in each case fitted on the insides of the side protective plates 27, on which guide rails 25 the carrier 11 slides over side recesses 25', leaving a gap. The guide rails 25 are adjustably attached to the side protective plates 27 by means of screws. In each case two parallel alignment pins 8 originate from the carrier 11, running above one another parallel to the protective plates, by means of which the carrier 11 and thus the power take-off connecting pieces 9 are aligned with respect to the supply connecting pieces 6. Power take-off connecting pieces 9 run through the plate of the mount in the central area of the carrier 11 and project forward out of the carrier 11. On the rear face of the plate of the carrier 11, the hydraulic connecting pieces 9 are connected by L-pieces to the hydraulic hoses (not illustrated) of the tool. Furthermore, the carrier 11 can also be prestressed to the rear, for example by means of its own tensioning springs or by the elasticity of the hydraulic hoses which are passed to the tool. As can be seen in FIGS. 14-17, latching elements 30, which project into the recesses 25' and interact with catches that are provided in the guide rails 25, can be provided in the plate of the carrier 11 in order to fix the mount in the moved-back position. A driver piece 12, which is provided with a T-head, projects from the front face of the carrier 11 underneath the power take-off connecting pieces 9, which project forward, and essentially parallel to them, with the T-head of the driver piece 12 being designed to engage in the T-groove 28 in the operating element 13 which is provided on the tool mount. The T-head of the driver piece 12 is broader in order to create an essentially T-shaped horizontal cross section which is of such a size that, when the quick-action coupling is folded in, a T-groove 28 of the operating element 13 is pushed over the T-head of the driver piece 12. The driver piece 12 is adjustably attached to the carrier 11 by means of a threaded piece and two nuts, which are used as lock nuts.

Figure 1:
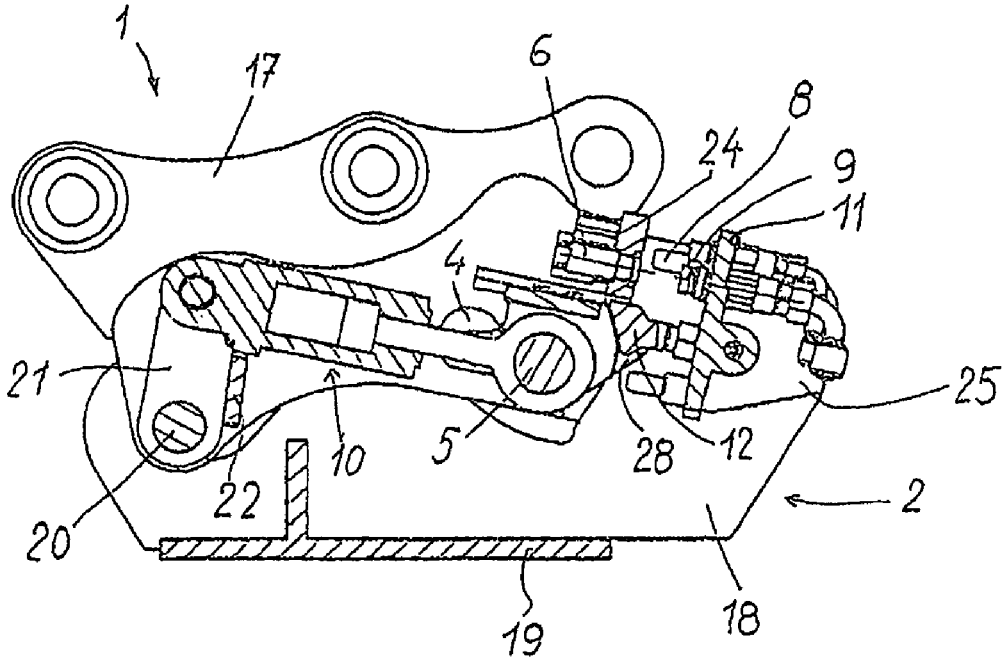
FIG. 1 shows the quick-action coupling according to the invention, after being pivoted in, in a section view along the line I-I in FIG. 2, with the blocking unit being unlocked and with the hydraulic coupling in the open position.
Figure 2:
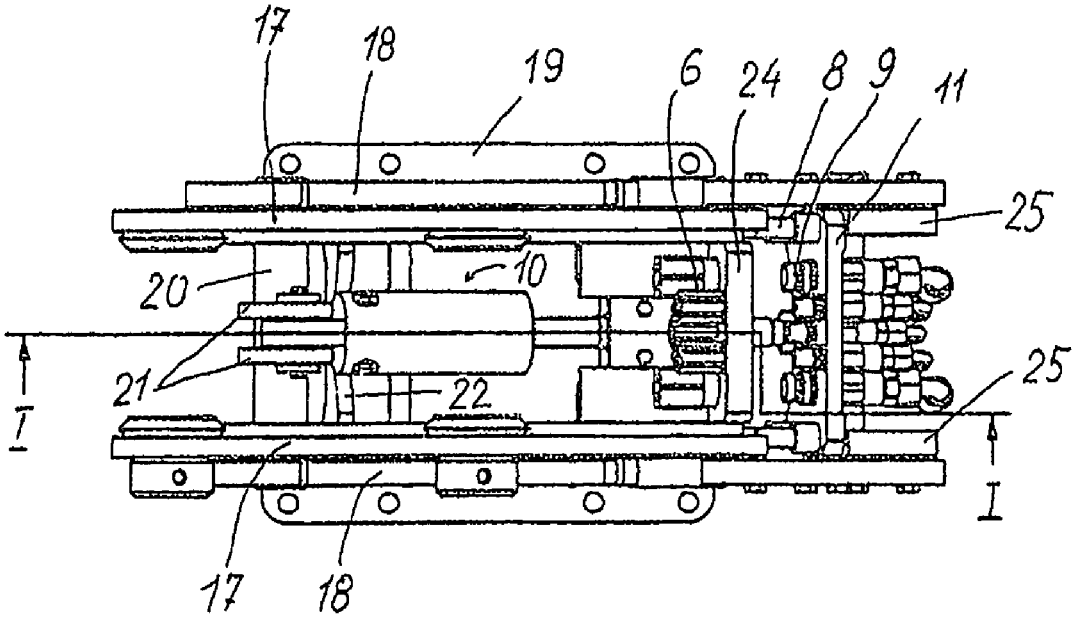
FIG. 2 shows a plan view of the quick-action coupling shown in FIG. 1.
Figure 3:
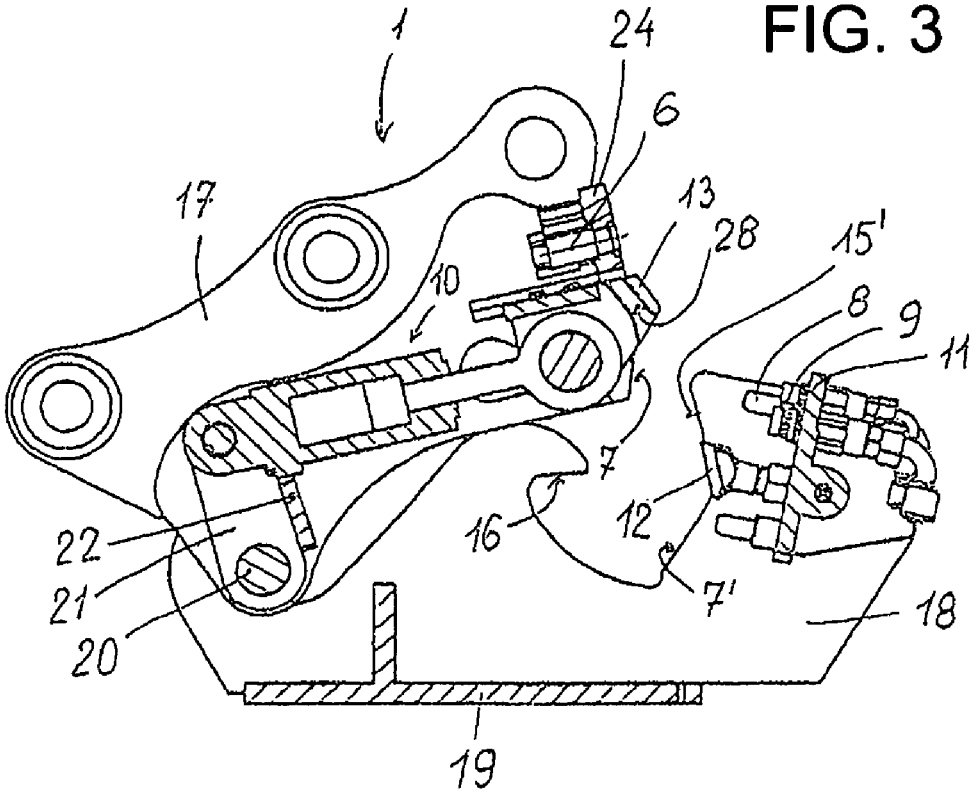
FIG. 3 shows the quick action coupling in the form of a section along the line III-III from FIG. 4 in the position in which the hook connection is hooked in, but the tool mount has not been pivoted to the closed position.
Figure 4:
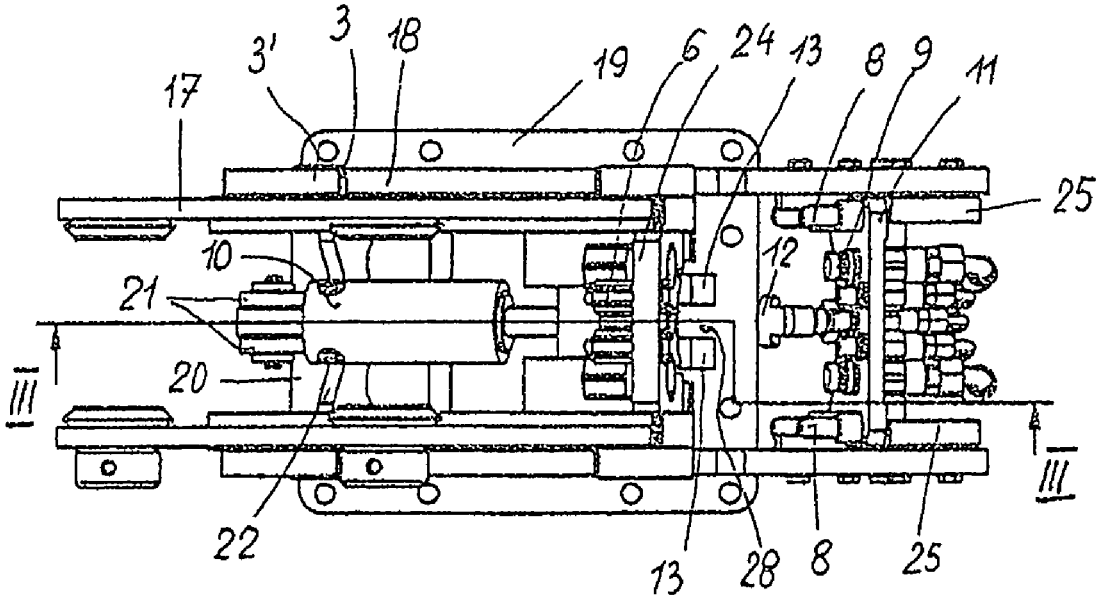
FIG. 4 shows a plan view of the quick-action coupling in the position shown in FIG. 3.

FIG. 3 and FIG. 4 show the position of the quick-action coupling before the tool mount 1 has been pivoted into the coupling part of the working tool 2, with the suspension bolt 3 already being suspended in the hook 3', but with the coupling not yet having been pivoted into the closed position. The method of operation of the present invention will be explained in the following text with reference to this figure. As is already known from AT 500 900 A1, mentioned above, the tool mount 1 which is mounted on the excavator boom is inserted obliquely from above with the suspension bolt 3 into the hook 3' of the working tool 2, which has been placed on or is provided, with the coupling plates 17 of the tool mount 1 being inserted between the mounting plates 18 of the tool 2, as can be seen in particular in FIG. 2. In order to pivot in the quick-action coupling (in the direction of the arrow), the wedge bar 5 must be in the unlocked position (that is to say the piston of the actuating unit 10 is extended) since, otherwise, the wedge bar 5 would strike against the locking attachment 26, thus preventing the quick-action coupling from being pivoted in. As a result of pivoting into the intermediate space, the wedge bar 5 passes between the locking attachment 26 and the side protective plate 27 of the tool, with the tool mount being pivoted in until the opposing pressure surface 7 of the tool mount rests on the corresponding opposing pressure surface 7' of the tool 2 (FIG. 1). During the pivoting-in process, the T-groove 28 of the operating element 13 is also pushed onto the T-head of the driver piece 12, with the pivoting-in movement being guided by the pivoting-in guide surfaces 15 and 15' of the tool mount and of the tool, as a result of which it is not possible for the T-head, which is designed to be relatively weak, of the driver piece 12 to be damaged as a result of the tool mount being in an incorrect position during the pivoting-in process. For this purpose, the two pivoting-in guide surfaces 15 and 15' are in this case aligned essentially tangentially with respect to a path which runs around the pivoting axis of the hook connection 3, 3'.

As soon as the quick-action coupling has been pivoted into the position illustrated in FIG. 1, the actuating unit 10 is operated in order to lock the quick-action coupling, as a result of which the wedge bar 5 is drawn along the guide slots 23 (see figures and 10) toward the locking attachments 26, until the wedge surfaces of the wedge bar 5 touch the wedge inclined surfaces 16 of the locking attachments 26. If the wedge bar 5 is now pulled further, this results on the one hand in the opposing pressure surfaces 7, 7' being pressed evermore firmly against one another by virtue of the wedge effect, and on the other hand being pressed evermore firmly into the hook 3' of the tool as a result of the effect of the opposing pressure surfaces 7, 7' of the suspension bolts 3 of the tool mount 1, thus resulting in the quick-action coupling being locked firmly and without play. At the same time that the actuating unit 10 is pulled, the operating element 13, the driver piece 12 which is suspended in it, and thus the entire carrier 11 are drawn forward along the guide rails 25, with the alignment bolts 8 engaging in corresponding retaining openings, and with the power take-off connecting pieces 9 being aligned precisely on the same axis with the supply connecting pieces 6, and with the power take-off connecting pieces 9 being inserted into the corresponding supply connecting pieces 6, thus automatically making the hydraulic connection to the tool.

Despite the high loads which occur on the wedge bar, the T-groove connection is subject to only small forces throughout the entire closing process since it transmits only the force which is required to move the mount and to push the power take-off connecting pieces 9 into the supply connecting pieces 6. It is therefore also possible to provide the guide for the carrier 11 on the one hand and the T-groove connection between the driver piece 12 and the operating element 13 on the other hand, with a considerable amount of play, since the carrier 11 is set by the alignment bolts 8 and therefore, as stated above, automatically aligns the power take-off connecting pieces 9 with the supply connecting pieces 6 which are located in the closure plate 24. The pulling direction of the operating element 13 need not coincide exactly with the movement direction of the carrier 11, since the T-head of the driver piece 12 can slide in the T-groove 28, because the pulling force is small, thus making it possible to compensate for position tolerances.

During opening of the blocking element 4, the operating element 13 exerts pressure on the head of the driver piece 12, as a result of which the carrier 11 is pushed back to the initial position. During this process, the power take-off connecting pieces 9 are drawn entirely out of the supply connecting pieces 6 before the wedge bar 5 is pushed back over the end of the wedge inclined surface 16, and the tool mount 1 can be folded about the pivoting axis of the hook connection 3, 3', out of the connection with the working tool 2, in order to release the quick-action coupling. In the moved-back position, the carrier 11 is held by the latching members 30, which engage in corresponding recesses in the guide rails 25, thus preventing the carrier 11 from unintentionally moving out of its rest position again and projecting into the pivoting-in path of the closure plate 24, which can lead to damage to the connecting pieces of the hydraulic lines when the tool mount 1 is being pivoted in. In addition, the carrier 11 can be prestressed to the rear, for example by springs, in such a way that the mount is drawn back when the blocking unit 4 is released, without having to transmit pressure forces via the driver piece 12 to do so.

The guidance, as illustrated in the figures, of the carrier 11 along guide rails 25 represents one preferred embodiment of the invention, but it is also possible to fit the mount such that it can pivot between the mounting plates 18, in such a way that the mount is "folded" onto the closure plate 24 during closure of the wedge lock. Which embodiment is actually preferable in a particular case depends in particular on the design of the supply connections and power take-off connections. In this case, the device according to the invention can be used not only for hydraulic connections but also for other connections, for example for electrical or pneumatic connections.

The invention claimed is:

1. A coupling apparatus with a device for automatic connection of hydraulic power lines, for attaching a working tool to a tool mount of an excavator boom by way of a quick-action coupling formed with a hook connection for connecting the tool mount to the working tool, comprising:

supply connecting pieces immovably mounted to the tool mount;

power take-off connecting pieces, corresponding to said supply connecting pieces, fixed on a carrier on the working tool;

said supply connecting pieces and said power take off connecting pieces being configured to form hydraulic connections;

a blocking unit with a movable bolt element movably disposed along a given direction of movement between a closed position and an open position, and an actuating unit for operating said blocking unit;

wherein, when said blocking unit is closed, said power take-off connecting pieces are connected to said supply connecting pieces and, when said blocking unit is open, said power take-off connecting pieces are detached from said supply connecting pieces;

said carrier being movably mounted on the working tool for movement along a given direction of movement between a moved-forward position and a retracted position; and said carrier having a driver piece for engagement with an operating element coupled to said movable bolt element; and wherein the given direction of movement of said carrier corresponds to the direction of movement of said bolt element.

2. The coupling apparatus according to claim 1, wherein said carrier is mounted with a play clearance relative to the working tool.

3. The coupling apparatus according to claim 1, which further comprises a latching device mounted on the working tool, for fixing said carrier in the retracted position when the working tool is disengaged.

4. The coupling apparatus according to claim 1, wherein the tool mount and the working tool are each formed with an inward-pivoting guide surface.

5. The coupling apparatus according to claim 1, wherein the tool mount and the working tool are each formed with two inward-pivoting guide surfaces on both sides along said operating element and on both sides along said driver piece, respectively.

6. A coupling apparatus with a device for automatic connection of hydraulic power lines, for attaching a working tool to a tool mount of an excavator boom by way of a quick-action coupling formed with a hook connection for connecting the tool mount to the working tool, comprising:

supply connecting pieces fixedly mounted to the tool mount;

power take-off connecting pieces, corresponding to said supply connecting pieces, fixed on a carrier on the working tool;

said supply connecting pieces and said power take off connecting pieces being configured to form hydraulic connections;

a blocking unit with a movable bolt element movably disposed along a given direction of movement between a closed position and an open position, and an actuating unit for operating said blocking unit;

wherein, when said blocking unit is closed, said power take-off connecting pieces are connected to said supply connecting pieces and, when said blocking unit is open, said power take-off connecting pieces are detached from said supply connecting pieces;

said carrier being movably mounted on the working tool for movement along a given direction of movement between a moved-forward position and a retracted position; and said carrier having a driver piece for engagement with an operating element coupled to said movable bolt element, wherein said operating element is formed with a T-groove and said driver piece is formed with a T-head fitting into said T-groove; and wherein the given direction of movement of said carrier corresponds to the direction of movement of said bolt element.

7. The coupling apparatus according to claim 6, wherein said driver piece is attached to said carrier for adjustment relative to a distance of said T-head from said carrier.

8. A coupling apparatus with a device for automatic connection of hydraulic power lines, for attaching a working tool to a tool mount of an excavator boom by way of a quick-action coupling formed with a hook connection for connecting the tool mount to the working tool, comprising:

supply connecting pieces fixedly mounted to the tool mount;

power take-off connecting pieces, corresponding to said supply connecting pieces, fixed on a carrier on the working tool;

said supply connecting pieces and said power take off connecting pieces being configured to form hydraulic connections;

a blocking unit with a movable bolt element movably disposed along a given direction of movement between a closed position and an open position, and an actuating unit for operating said blocking unit;

wherein, when said blocking unit is closed, said power take-off connecting pieces are connected to said supply connecting pieces and, when said blocking unit is open, said power take-off connecting pieces are detached from said supply connecting pieces;

said carrier being movably mounted on the working tool for movement along a given direction of movement between a moved-forward position and a retracted position; and said carrier having a driver piece for engagement with an operating element coupled to said movable bolt element;

wherein the given direction of movement of said carrier corresponds to the direction of movement of said bolt element; and wherein said bolt element of said blocking unit is a transverse bar, flattened in the form of a wedge at least at the ends thereof and having said actuating unit fitted centrally thereto, wherein a wedge point or wedge points run parallel to a longitudinal axis of said transverse bar and are aligned toward said actuating unit, wherein said operating element is attached to said transverse bar centrally on a wedge rear face, and wherein said supply connecting pieces of the tool mount are arranged above a wedge center plane and behind a wedge rear face.

* * * * *